US008125402B2

(12) United States Patent
Crouch et al.

(10) Patent No.: US 8,125,402 B2
(45) Date of Patent: Feb. 28, 2012

(54) METHODS AND APPARATUS FOR MULTILAYER MILLIMETER-WAVE WINDOW

(75) Inventors: David Crouch, Corona, CA (US); William E. Dolash, Montclair, CA (US)

(73) Assignee: Raytheon Company, Waltham, MA (US)

( * ) Notice: Subject to any disclaimer, the term of this patent is extended or adjusted under 35 U.S.C. 154(b) by 521 days.

(21) Appl. No.: 12/350,797

(22) Filed: Jan. 8, 2009

(65) Prior Publication Data

US 2009/0174621 A1 Jul. 9, 2009

Related U.S. Application Data

(60) Provisional application No. 61/019,719, filed on Jan. 8, 2008.

(51) Int. Cl.
*H01Q 1/42* (2006.01)

(52) U.S. Cl. ..... 343/872; 343/909; 343/705

(58) Field of Classification Search ..... 343/872, 343/909, 705; 333/21 A, 252
See application file for complete search history.

(56) References Cited

U.S. PATENT DOCUMENTS

| | | | | |
|---|---|---|---|---|
| 5,103,241 | A * | 4/1992 | Wu | 343/909 |
| 5,184,141 | A | 2/1993 | Connolly et al. | |
| 6,157,349 | A | 12/2000 | Crouch | |
| 6,208,316 | B1 * | 3/2001 | Cahill | 343/909 |
| 6,323,825 | B1 | 11/2001 | Zidek et al. | |
| 7,688,278 | B2 * | 3/2010 | Frenkel | 343/872 |
| 2003/0001699 | A1 | 1/2003 | Crouch et al. | |
| 2007/0079936 | A1 | 4/2007 | Li et al. | |

OTHER PUBLICATIONS

European Patent Office, International Search Report for International Application No. PCT/US2009/030418, Mail Date Mar. 20, 2009.

* cited by examiner

*Primary Examiner* — Tan Ho
(74) *Attorney, Agent, or Firm* — Daly, Crowley, Mofford & Durkee, LLP

(57) ABSTRACT

Methods and apparatus for a multilayer millimeter-wave window according to various aspects of the present invention operate in conjunction with a multilayer window that is substantially transparent to a passing millimeter-wave. The window may include multiple perforations in a thermally conductive element to be disposed in the path of the passing wave. A dielectric is positioned between each thermally conductive element and acts as a seal between wave source and an ambient environment. The window may also be configured to conform to a contoured surface or structure.

29 Claims, 5 Drawing Sheets

METHODS AND APPARATUS FOR MULTILAYER MILLIMETER-WAVE WINDOW

CROSS-REFERENCE TO RELATED APPLICATION

This application claims the benefit of U.S. Provisional Patent Application No. 61/019,719, filed Jan. 8, 2008 and incorporates the disclosure of that application by reference.

BACKGROUND OF INVENTION

Systems that generate and/or transmit high-frequency electromagnetic radiation often require a window that is transparent over a particular frequency range. To accommodate high power levels, the window may be highly transparent to the passing radiation, absorb and/or reflect little of the transmitted power, and present a low thermal resistance path to heat generated within the window by any absorbed radiation. At millimeter-wave frequencies, the loss tangents of many materials commonly used for windows at lower frequencies become much higher, reducing the effectiveness of such materials at millimeter-wave frequencies.

Synthetic diamond has emerged as a preferred window dielectric material in millimeter-wave applications. This is especially true in instances where there is an extremely high power density millimeter wave, such as at the output windows of gyrotron oscillators that produce outputs in excess of 1 MW. Although synthetic diamond has a low loss tangent at millimeter-wave frequencies and a thermal conductivity higher than copper, it is expensive and often available only in limited sizes. In applications where the size of the window needs to be greater than a few inches across, synthetic diamond becomes cost prohibitive.

SUMMARY OF THE INVENTION

Methods and apparatus for a multilayer millimeter-wave window according to various aspects of the present invention operate in conjunction with a multilayer window that is substantially transparent to a passing millimeter-wave. The window may include multiple perforations in a thermally conductive element to be disposed in the path of the passing wave. A dielectric is positioned between at least two thermally conductive elements and acts as a seal between the wave source and an ambient environment. The window may also be configured to conform to a contoured surface or structure.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to improve understanding of embodiments of the present invention.

DETAILED DESCRIPTION OF EXEMPLARY EMBODIMENTS

The present invention may be described partly in terms of functional components and various methods. Such functional components may be realized by any number of components configured to perform the specified functions and achieve the various results. For example, the present invention may employ various techniques for passing electromagnetic radiation, e.g., windows, radomes, and the like, which may carry out a variety of functions. In addition, the present invention may be practiced in conjunction with any number of electromagnetic radiation sources, millimeter wavelength beams, gyrotrons, and high energy wave sources, and the system described is merely one exemplary application for the invention. Further, the present invention may employ any number of conventional techniques for generating radiation, forming radomes, coupling to aircraft, connecting the elements together, transmitting and/or receiving radio frequency transmissions, and the like.

Figure 1:
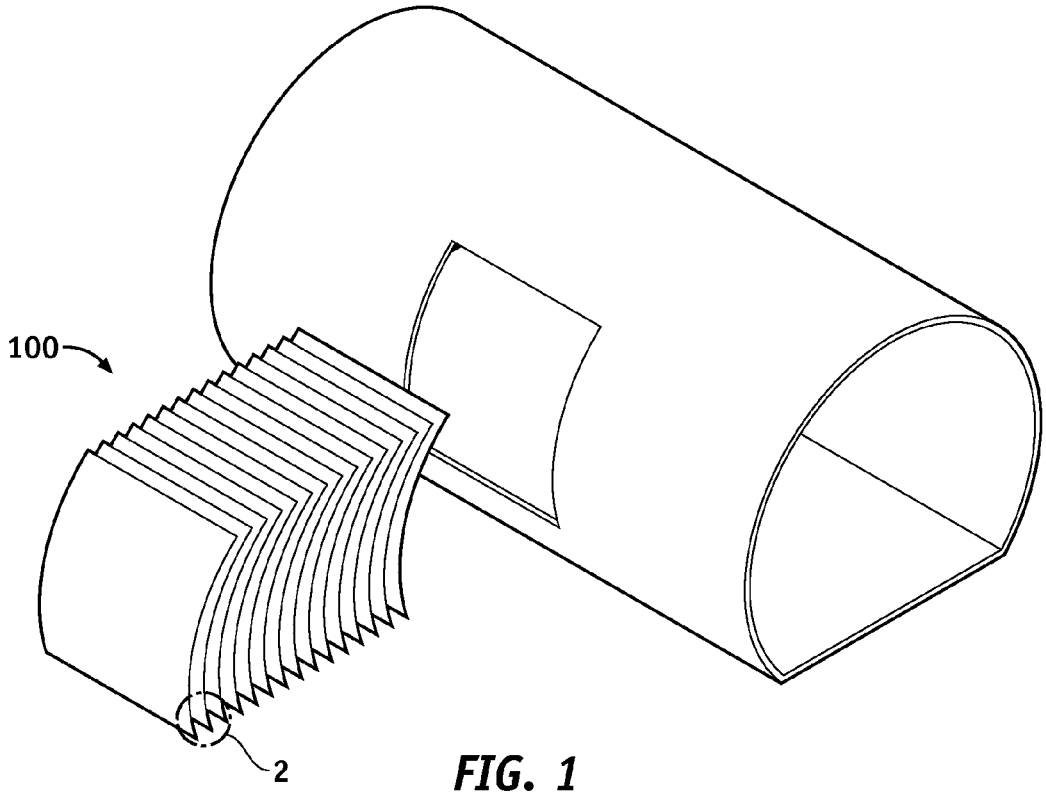
FIG. 1 representatively illustrates a multilayer window in accordance with an exemplary embodiment of the present invention.
Figure 2:
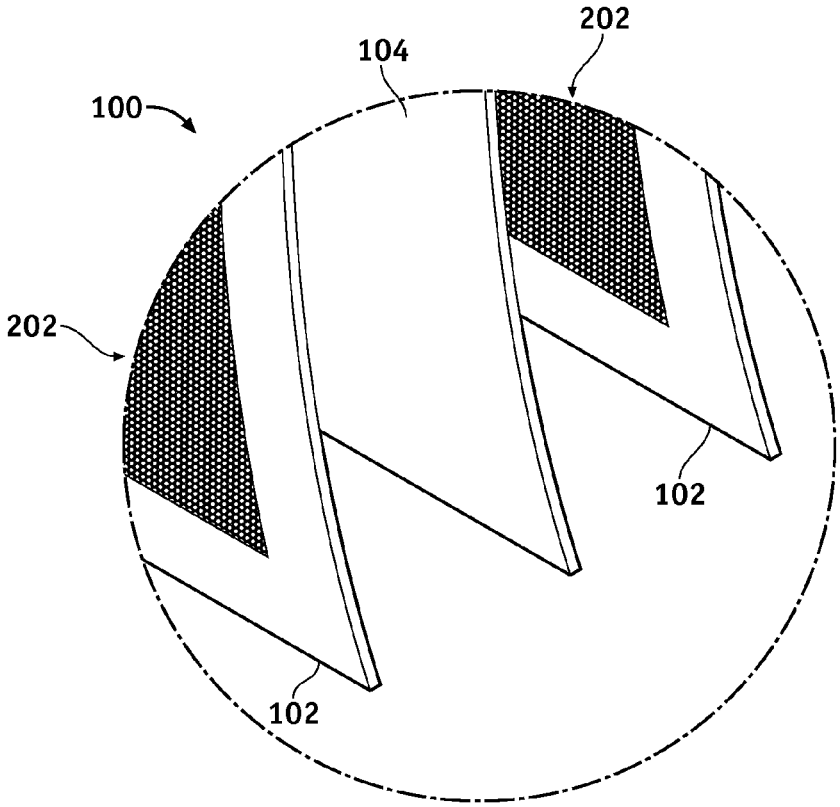
FIG. 2 representatively illustrates various layers of the multilayer window.

Referring now to FIG. 1, methods and apparatus for passing high frequency electromagnetic radiation according to various aspects of the present invention may operate in conjunction with a multilayer window 100. The multilayer window 100 may be substantially transparent to a passing energy wave at one or more particular frequencies or ranges of frequencies. Referring to FIGS. 1 and 2, in one embodiment, the multilayer window 100 may comprise at least two thermally conductive elements 102 and a dielectric 104 disposed between the at least two thermally conductive elements 102. Each thermally conductive element 102 may further comprise multiple perforations 202. The multilayer window 100 may comprise additional components, such as a mounting device and/or sealing elements.

The dielectric 104 provides a seal between a radiation source and an environment where the radiation is directed while also contributing to the substantial transparency of the multilayer window 100 to the passing energy wave. The dielectric 104 may also provide a seal between each thermally conductive element 102. The dielectric 104 may comprise any suitable system for sealing two regions from each other while remaining substantially transparent to a passing energy wave when assembled in the multilayer window 100. The dielectric 104 may comprise a plate, a sheet, a flexible material, or a material which may conform to a contoured surface.

For example, in one embodiment, the dielectric 104 may comprise a flat plate and be suitably configured to maintain a vacuum on a side of the multilayer window 100 where an electromagnetic radiation generator, such as a gyrotron, is located. In a second embodiment, the dielectric 104 may comprise a contoured sheet and provide an environmental seal between an interior surface and an exterior surface of the multilayer window 100. The dielectric 104 may be further suitably adapted to maintain a pressurization difference between an interior space and an external environment. The dielectric 104 may also inhibit foreign object debris from ingressing into the perforations 202, which may result in reduced performance of the multilayer window 100.

Figure 3:
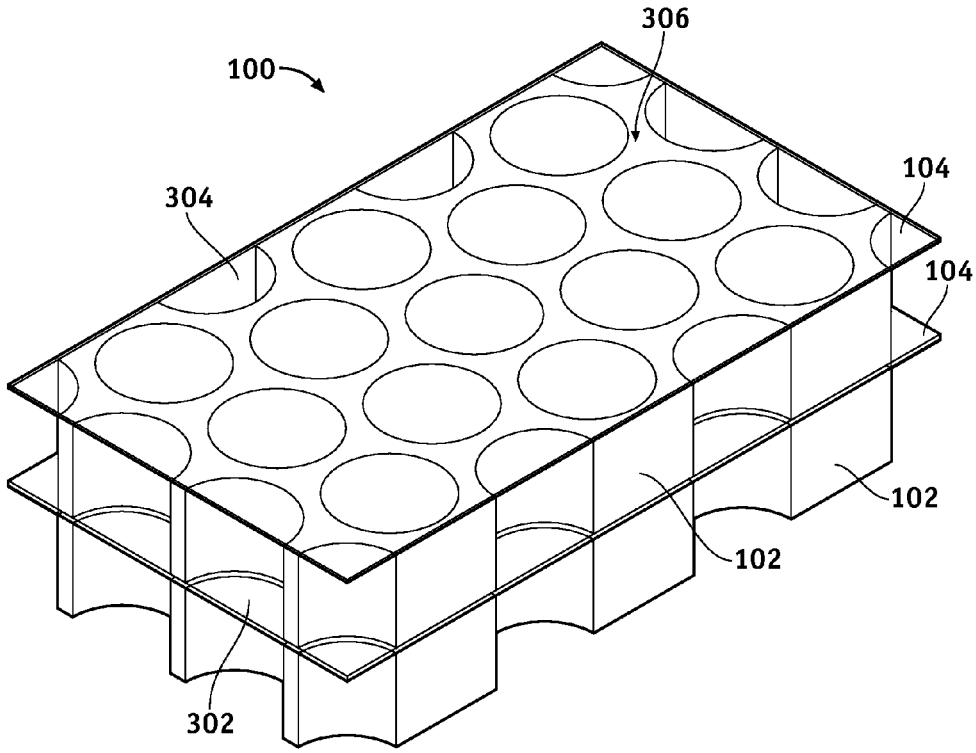
FIG. 3 illustrates a two-layer window.

Referring to FIG. 3, in one embodiment, multiple dielectrics 104 may be coupled to the thermally conductive elements 102, providing multiple seals to a built up multilayer window 100. For example, a first dielectric 302 may be disposed between two thermally conductive elements 102, sealing the two elements from each other. A second dielectric 304 may be coupled to a surface of one of the outermost thermally conductive elements 102, providing a cap to the multilayer window 100. The second dielectric 304 may form a second seal that is adapted to perform multiple functions, such as isolatively sealing the perforations 202 that are disposed between the two dielectrics 302, 304 from another set of perforations 202 and providing a seal to the entire multilayer window 100. The use of multiple dielectrics 104 may also improve reliability by preventing a window failure should any one dielectric 104 layer develop a crack, a hole, or a tear.

The dielectric 104 may also provide a suitable loss tangent at operational frequencies in the millimeter-wave spectrum, such as according to the power density of the incident beam, the thickness of each dielectric layer, and the melting point of a polymer. For example, in an application in which the window maintains a vacuum seal, the dielectric 104 that separates adjacent thermally conductive elements 102 may be constructed from a low-loss ceramic, such as alumina or sapphire. In various embodiments, the dielectric 104 may comprise a low-loss ceramic that conforms to a non-planar surface.

Unlike a traditional all-dielectric window, the thermal conductivity of the dielectric 104 in the multilayer window 100 is less problematic. In a conventional all-dielectric window, heat travels from its point of origin to the periphery of the window before it can be removed. In the present embodiment, the thermally conductive elements 102 conduct heat away from the dielectric 104 more locally to where the heat is generated. Referring to the embodiments of FIGS. 3 and 4, heat travels through the dielectric 104 to the nearest thermal element-dielectric boundary 306, thus reducing the effective thermal resistance of the window. Therefore, the dielectric 104 may comprise thicknesses that are unobtainable in an all-dielectric window. For example, dielectric plates made of traditional ceramics, such as sapphire or quartz, are highly susceptible to breaking if made too thin. If the dielectric 104 is configured to use the thermal conductance of the thermally conductive elements 102 to dissipate heat, then the dielectric 104 may comprise other materials which are less fragile and may be on the order of only a few thousandths of an inch thick.

Additionally, for applications in which outgassing by the dielectric 104 is acceptable, less expensive low-loss dielectrics 104 materials may be used. For example, the dielectric 104 may comprise a polymer, such as a polyimide film, polytetrafluoroethene, or high-density polyethylene film. In one embodiment, the dielectric 104 comprises a Teflon® plate of between two thousandths of an inch and five thousandths of an inch thick while providing a loss tangent of approximately $5.0\times10^{-4}$ at 94 GHz. In another embodiment, the dielectric 104 may comprise a polyester film that is between 0.5 thousandths of an inch and one thousandth of an inch thick.

Thermally conductive elements 102 contribute to the transparency of the multilayer window 100 to a beamed energy wave at a selected radio frequency or set of frequencies and conduct heat generated within the dielectric 104 to the ambient environment and/or a cooling system. The thermally conductive elements 102 may comprise any suitable low thermal resistance path system for allowing a beamed energy wave to pass through with little reflection or loss of transmitted energy. The low thermal resistance path may comprise, for example, a flat plate, a lattice, or a body that may be molded, cast, formed, machined, extruded, or otherwise manufactured into a non-linear or multi-planar shape. Referring again to FIG. 2, the thermally conductive elements 102 comprise a thermally conductive body with multiple perforations 202, or holes, disposed in a surface of the thermally conductive elements 102. In the present embodiment, several thermally conductive elements 102 are coupled together to form the multilayer window 100.

Figure 4:
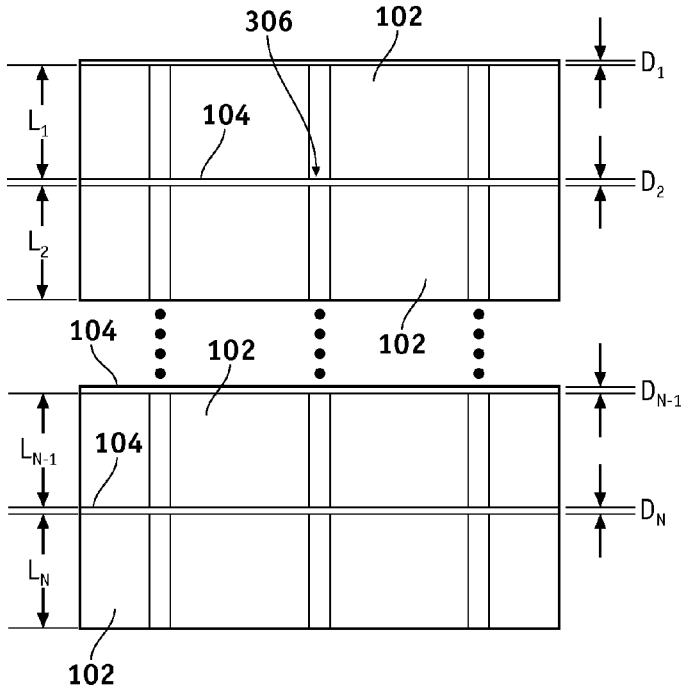
FIG. 4 is a cross-section of a multilayer window.
Figure 5:
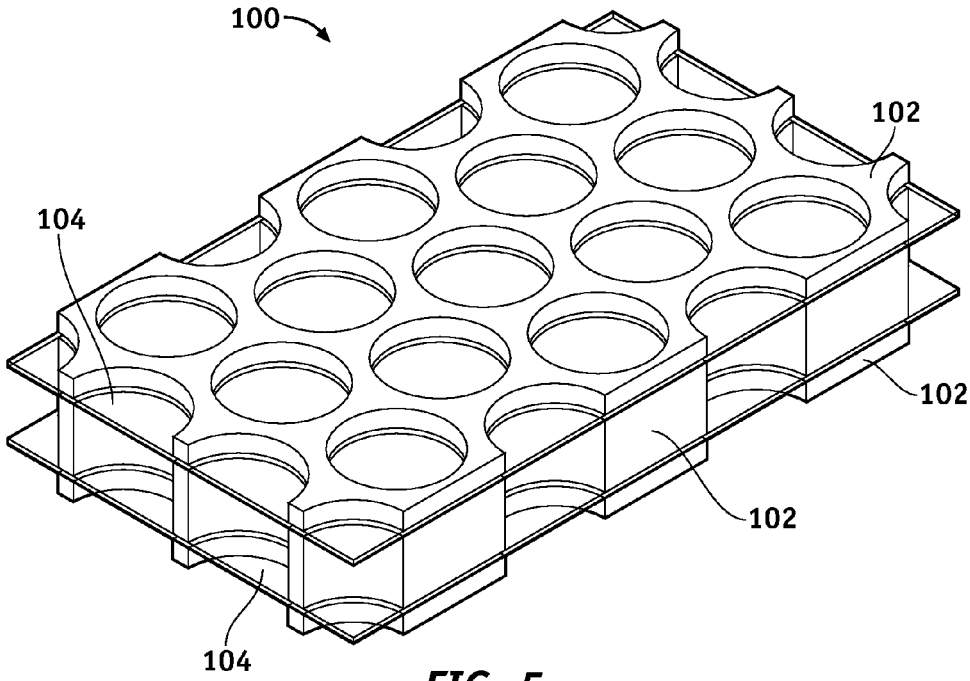
FIG. 5 illustrates a three-layer window.
Figure 6:
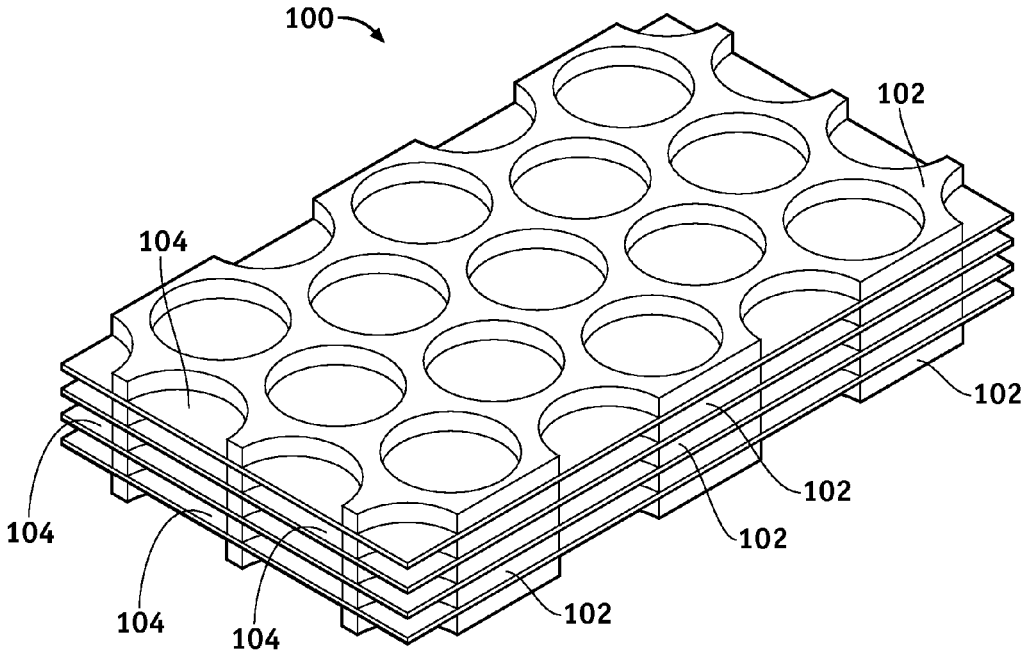
FIG. 6 illustrates a five-layer window.

Referring now to FIG. 4, each thermally conductive element 102 may be separated from another thermally conductive element 102 by the dielectric 104. The thickness of the thermally conductive elements 102 may be defined by a value L, for example $L_1$, $L_2$, $L_{N-1}$, and $L_N$ and the thickness of each layer of the dielectric 104 may be defined by a value D, for example $D_1$, $D_2$, $D_{N-1}$, and $D_N$. Moreover, the multilayer window 100 may comprise any suitable number of layers from 1 to N. The thickness of each element may be the same for each layer of the window or they may vary from layer to layer. For example, an outermost layer of the thermally conductive element 102 may be configured to be only a few thousandths of an inch thick to reduce the volume within the perforations 202 that may be filled with foreign particles. Alternatively, the thickness of the thermally conductive elements 102 may vary based on factors such as structural requirements or weight limitations.

The thermally conductive elements 102 may also comprise any suitable shape or size. For example, in one embodiment, an individual thermally conductive element 102 may comprise a circular plate of less than three inches in diameter. In another embodiment, each thermally conductive element 102 may comprise a circular plate of between four and ten inches in diameter. In yet another embodiment, each thermally conductive element 102 may comprise a substantially rectangular or square shape of up to four feet along one side.

Referring to FIGS. 3-6, the number of thermally conductive elements 102 and dielectrics 104 used to form a multilayer window 100 may be dependent on a particular application, operating frequency, radiation source, or installation location. In one embodiment, the thermally conductive elements 102 may further provide structural stability to the multilayer window 100. In another embodiment, multiple thin formable thermally conductive elements 102 may be coupled together, allowing the multilayer window 100 to be installed in locations that require a more complex shape than a simple flat window. For example, structural requirements may require a single element to be so thick as to make it difficult to conform to a complex or contoured surface. The type of material used to form the thermally conductive elements 102 may be varied to adjust the overall strength or thermal conductance of the multilayer window 100.

Figure 7:
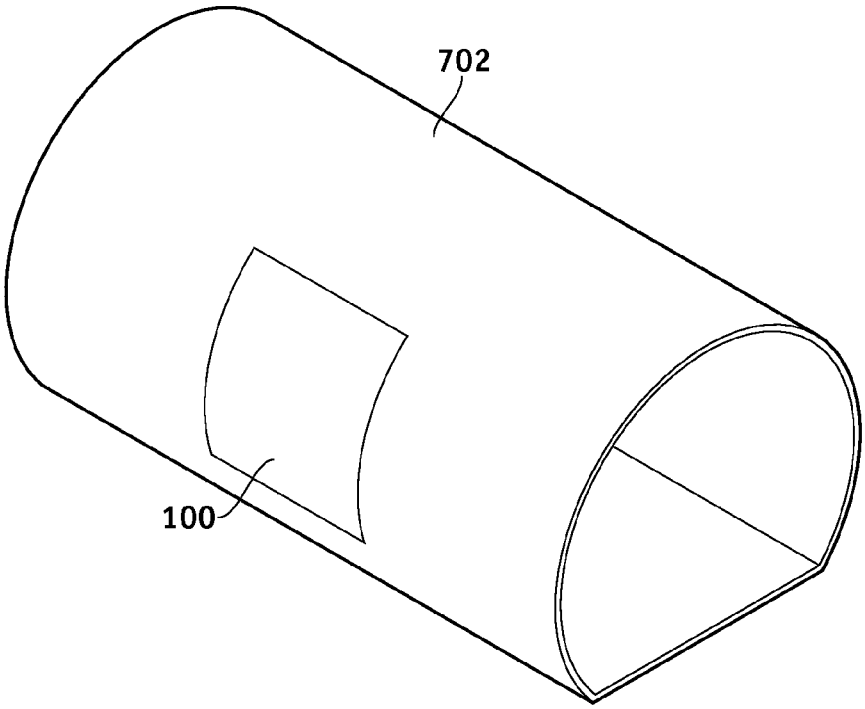
FIG. 7 illustrates a multilayer window installed in an aircraft fuselage.

For example, referring now to FIG. 7, a section of an aircraft fuselage 702 may be replaced by the multilayer window 100. The number of thermally conductive elements 102 and the amount of structural strength required may be dependent upon the type of aircraft and/or the amount of structure removed. For example, a section removed from a pressurizable cabin may require substantially more structural integrity than a section removed from a section of the aircraft that is not pressurized, such as a nose cone or baggage compartment. Additionally, if the section of fuselage 702 removed includes structural support such as ribs in addition to the aircraft skin, then the number of thermally conductive elements 102 may be increased to ensure the integrity of the aircraft during flight.

The thermally conductive elements 102 may conduct heat generated by the dielectric 104 in any suitable manner and may comprise any suitable material such as metal and metallic alloys, such as aluminum, copper, beryllium, or any suitable combination thereof. The thermally conductive elements 102 may also comprise a composite material, such as a high strength thermally conductive plastic or be integrated with a liquid cooling system. Depending on a particular application or operating frequency, the thermally conductive elements 102 may be required to dissipate as much as several kilowatts of power absorbed by either the dielectric 104 and/or the thermally conductive elements 102 themselves as a result of the passage of the high frequency energy beam through the multilayer window 100.

The thermally conductive elements 102 may further be adapted to be electrically conductive. Electrical conductivity may tend to avoid or reduce ohmic losses of the thermally conductive elements 102 as the energy wave passes through the multilayer window 100, resulting in a reduced ability to dissipate heat. Thermally conductive elements may be selected according to any suitable criteria, such as thermal and/or electrical properties at relevant operational frequencies for the passing wave.

Figure 8:
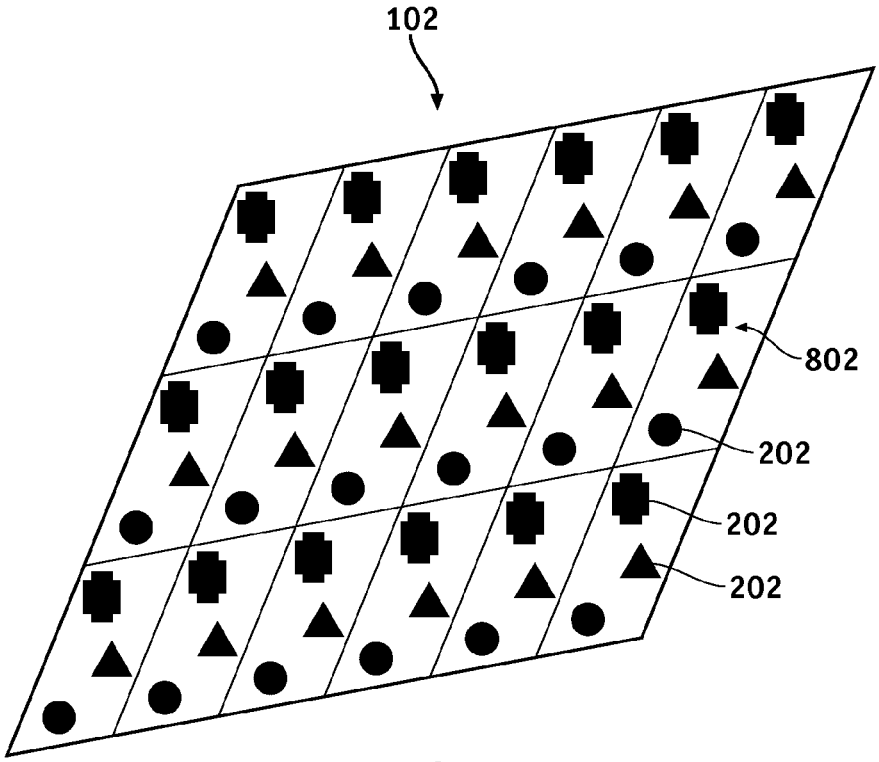
FIG. 8 illustrates a periodic lattice network.
Figure 9:
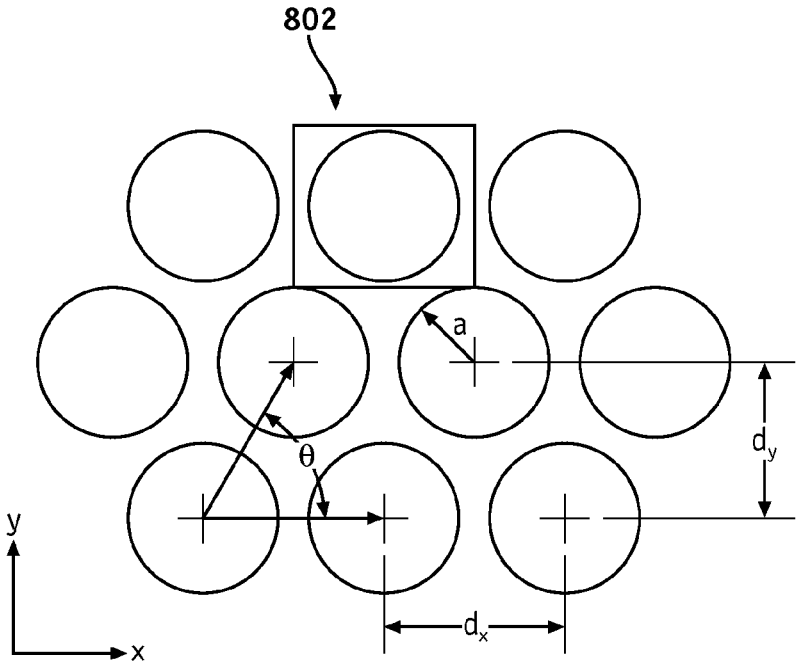
FIG. 9 illustrates spacing variables associated with a lattice network.

The thermally conductive elements 102 may include perforations 202, such as to facilitate transmission of an energy wave at one or more selected frequencies. The perforations 202 may comprise any suitable shape or size. For example, referring to FIGS. 2 and 8, the perforations 202 may comprise a pattern of one or more holes for a unit area 802. The pattern may be repeated over the entire surface, forming a periodic lattice network of holes. The perforations 202 may be configured in any suitable number per unit area 802, such as according to a particular operating frequency. Referring to FIG. 9, the lattice network may comprise one circular hole per unit area 802. The center-to-center separation between holes of radius a may be defined by the distance $d_x$ along an x axis, and the distance between neighboring rows may be $d_y$. The angular offset between hole centers in neighboring rows may be denoted by θ.

The spacing of the perforations 202 may also be defined according to any suitable coordinate system, optimization algorithm, or the like. For example, the arrangement of the lattice network may be determined by a cost function which takes into account factors such as operating frequency, incident power of the directed energy wave, thickness of the thermally conductive elements 102, diameter of the perforations 202, separation between holes, and the type of materials used for the dielectric 104 and the thermally conductive elements 102.

For example, referring to FIG. 3 and Table 1, a spacing of perforations 202 for a two layer window with an operating frequency of 94 GHz may result in a reflection coefficient is −47.5 dB; that is, for every kilowatt of incident power, only 0.0178 Watts is reflected. The multilayer window 100 may also have substantial bandwidth, by providing a reflection coefficient of less than −20 dB from a frequency of less than 90 GHz tip to 96.5 GHz.

A similar optimization process may be performed for the number of perforations 202 and/or thicknesses of the thermally conductive elements 102 and dielectrics 104 for other configurations of multilayer windows 100. For example, Tables 2 and 3 show calculated values for a three-layer and a five-layer window optimized for an operating frequency range of 92 GHz to 96 GHz.

TABLE 1

| Two-layer window | | |
|---|---|---|
| Parameter | Value | Units |
| θ | 60 | Degrees |
| a | 51 | mils |
| $d_x$ | 114.6 | mils |
| $d_y$ | $d_x \sin\theta$ | |
| $L_1 = L_2$ | 85 | mils |
| $D_1$ | 2 | mils |
| $D_2$ | 5 | mils |

TABLE 2

| Three-layer window | | |
|---|---|---|
| Parameter | Value | Units |
| θ | 60 | degrees |
| a | 50.2 | mils |
| $d_x$ | 119.6 | mils |
| $d_y$ | $d_x \sin\theta$ | |
| $L_1$ | 20 | mils |
| $L_2$ | 57 | mils |
| $L_3$ | 20 | mils |
| $D_1$ | 0 | mils |
| $D_2 = D_3$ | 2 | mils |

TABLE 3

| Five-layer window | | |
|---|---|---|
| Parameter | Value | Units |
| θ | 60 | degrees |
| a | 50.2 | mils |
| $d_x$ | 119.6 | mils |
| $d_y$ | $d_x \sin\theta$ | |
| $L_1 = L_2 = L_3 = L_4 = L_5$ | 20 | mils |
| $D_0$ | 0 | mils |
| $D_1 = D_2 = D_3 = D_4$ | 2 | mils |

The perforations 202 may also be positioned such that when several thermally conductive elements 202 are coupled, or stacked together, the perforations 202 on each thermally conductive element 102 are aligned with the perforations 202 of an adjacent thermally conductive element 102. Alternatively, the size and shape of the perforations 202 on each thermally conductive element 102 may vary relative to those of an adjacent thermally conductive element 102 and/or portion of the same thermally conductive element 102 when the multilayer window 100 is configured to conform to a non-flat surface, such as an aircraft fuselage, to compensate for anticipated deformations of the holes when shaped. For example, perforations 202 of the same size that would be perfectly aligned if the multiple layers were stacked in a series of flat layers may not be adequately aligned when the layers are formed into a curve to form a non-flat surface. Consequently, the size and shape of various perforations may be adjusted to properly align the perforations in the final implementation.

In accordance with an exemplary embodiment of the present invention, a mounting device may couple the thermally conductive elements 102 to the dielectrics 104 and/or facilitate installation of the multilayer window 100 into a structure. The mounting device may comprise any suitable system for securing or attaching the individual layers of the multilayer window 100 together, such as mechanical fasteners, adhesives, and the like. The mounting device may also provide a thermal path from the thermally conductive elements 102 to the ambient environment, other suitable structure, or a cooling system.

Figure 10:
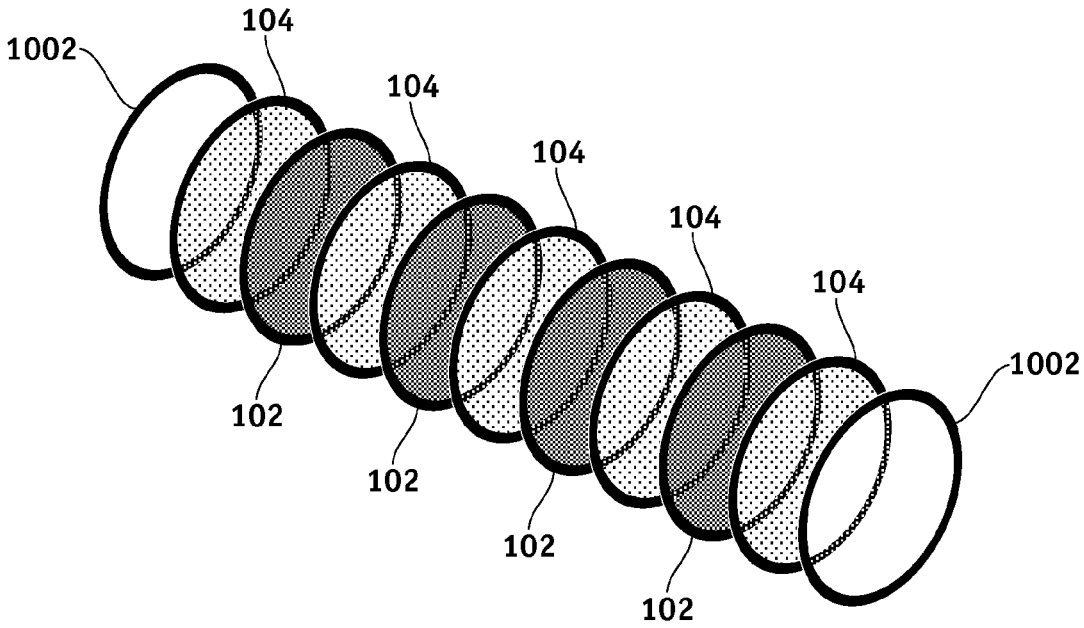
FIG. 10 illustrates a multilayer window coupled together by a mounting device.

For example, referring to FIG. 10, the mounting device may comprise a retaining ring 1002 suitably configured to maintain close contact between the dielectrics 104 and their neighboring thermally conductive elements 102, forming a low-resistance thermal path from the dielectric 104 into the adjoining thermally conductive elements 102. The mounting device may be installed into an opening to separate a millimeter wave source from a targeted environment.

For example, referring again to FIG. 7, the multilayer window 100 may fit a large opening in the side of an aircraft fuselage housing a high-power millimeter-wave system (not shown), which may generate and radiate a high-power millimeter-wave beam that passes through the multilayer window 100. The mounting device may couple the individual elements while also securing them to the fuselage. The multilayered window 100 may also provide an air-tight seal and support airframe integrity.

In operation, a high-power millimeter wave source passes an energy beam through the multilayer window 100. The multilayer window 100 is configured to seal the wave source from an outside environment while being substantially transparent to the passing beam. The multilayer window 100 may comprise a thin dielectric 104 film disposed between thermally conductive elements 102. In an alternative embodiment, several layers of dielectrics 104 disposed between thermally conductive elements 102 may also be coupled together to form the multilayer window 100.

The multilayer window 100 may allow the high-power wave to pass in any appropriate manner, such as by placing several perforations 202 on a surface of each thermally conductive element 102. In the present embodiment, the perforations are arranged in a periodic lattice network, wherein the spacing of the perforations is suitably optimized for a particular operational frequency and angle of incidence. As the millimeter wave passes through the multilayer window 100, some of the energy is absorbed by the dielectric 104 and converted into heat. This heat is then conducted away from the dielectric 104 by the thermally conductive elements 102. An additional cooling system may be used to conduct heat from the thermally conductive elements 102 and/or the heat may be passively radiated to the surrounding environment.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including". "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A multilayer window for passing millimeter-wave radiation, comprising:

at least two thermally conductive plates coupled together forming multiple layers, wherein:

each of the at least two thermally conductive plates comprises a set of perforations passing through a surface; and the at least two thermally conductive plates are configured to substantially transmit millimeter-wave radiation within a predetermined operating frequency range; and a dielectric spacer disposed between the at least two thermally conductive plates, wherein:

the dielectric spacer forms a seal between the at least two thermally conductive plates; and the at least two thermally conductive plates directly contact the dielectric spacer.

2. A multilayer window according to claim 1, wherein the at least two thermally conductive plates and the dielectric spacer conform to a non-planar surface.

3. A multilayer window according to claim 1, wherein the at least two thermally conductive plates are electrically conductive.

4. A multilayer window according to claim 1, wherein the set of perforations comprises a group of holes arranged in a periodic lattice network over a surface of each of the at least two thermally conductive plates.

5. A multilayer window according to claim 4, wherein the holes of a first thermally conductive plate align with the holes of a second thermally conductive plate relative to the passing millimeter-wave radiation.

6. A multilayer window according to claim 5, wherein:

the holes of the first thermally conductive plate comprise the same shape as the holes of the second thermally conductive plate; and the holes of the first thermally conductive plate comprise a different size than the holes of a second thermally conductive plate.

7. A multilayer window according to claim 1, further comprising a dielectric cover coupled to one of the at least two thermally conductive plates.

8. A multilayer window according to claim 1, further comprising a mounting device coupling the at least two thermally conductive plates to the dielectric spacer and adapted to mount the coupled plates to a separate structure.

9. The multilayer window of claim 1, wherein the dielectric spacer has a thickness from 0.0005 inches to 0.005 inches.

10. The multilayer window of claim 9, wherein each thermally conductive plate has a thickness from 0.020 inches to 0.085 inches.

11. The multilayer window of claim 1, wherein the dielectric spacer is a ceramic material, and the multilayer window is adapted to maintain a vacuum between an interior space and an external environment separated by the multilayer window.

12. A multilayer radome for passing millimeter-wave electromagnetic radiation, comprising:

at least two thermally conductive perforated metallic elements plates coupled together forming multiple layers, wherein:

the least two thermally conductive perforated metallic plates each comprise a set of perforations;

the at least two thermally conductive perforated metallic plates are adapted to be substantially transparent to millimeter-wave radiation within a predetermined operating frequency range; and a dielectric spacer disposed between the at least two thermally conductive perforated metallic plates, wherein the dielectric spacer provides a seal between the least two thermally conductive perforated metallic plates; and wherein the at least two thermally conductive perforated metallic plates and the dielectric spacer define a non-planar surface when coupled together.

13. A multilayer radome according to claim 12, wherein:

the non-planar surface comprises a section of an aircraft; and the coupled thermally conductive perforated metallic plates are configured to provide substantially equivalent structural strength as an adjacent section of the aircraft.

14. A multilayer radome according to claim 13, further comprising a mounting device securing the at least two thermally conductive metallic plates to the dielectric spacer to form a coupled system and adapted to mount the coupled system to a separate structure.

15. A multilayer radome according to claim 12, wherein the set of perforations on each of the least two thermally conductive perforated metallic plates comprises a group of holes arranged in a periodic lattice network over a surface of each of the at least two thermally conductive perforated metallic plates.

16. A multilayer radome according to claim 15, wherein the holes of a first layer align with the holes of a second layer.

17. A multilayer radome according to claim 16, wherein:

the holes of the first thermally conductive perforated metallic plate comprise the same shape as the holes of the second thermally conductive perforated metallic plate; and the holes of the first thermally conductive plate comprise a different size than the holes of a second thermally conductive perforated metallic plate.

18. A multilayer radome according to claim 12, further comprising a dielectric cover coupled to one of the at least two thermally conductive perforated metallic plates.

19. A multilayer radome according to claim 18, wherein the dielectric spacer and the dielectric cover comprise an identical dielectric material.

20. The multilayer radome of claim 12, wherein the dielectric spacer has a thickness from 0.0005 inches to 0.005 inches.

21. The multilayer radome of claim 20, wherein each thermally conductive perforated metallic plate has a thickness from 0.020 inches to 0.085 inches.

22. The multilayer radome of claim 12, wherein the dielectric spacer is a ceramic material, and the multilayer radome is adapted to maintain a vacuum between an interior space and an external environment separated by the multilayer radome.

23. A method for transmitting millimeter-wave radiation comprising:

coupling a dielectric spacer between two thermally conductive metallic plates to form a multilayer window; and perforating each of the thermally conductive metallic plates, wherein the perforations are configured to make each of the thermally conductive metallic plates substantially transparent to millimeter-wave radiation within a predetermined operating frequency range.

24. The method according to claim 23, wherein, the perforations comprise a series of holes arranged in a periodic lattice network.

25. The method according to claim 23, wherein the perforations of each of the thermally conductive metallic plates are aligned when the thermally conductive metallic plates are coupled together.

26. The method according to claim 25, further comprising sealing each layer of the multilayer window from another layer, wherein the dielectric spacer is configured to create the seal between each layer.

27. The method according to claim 23, wherein the dielectric spacer has a thickness from 0.0005 inches to 0.005 inches.

28. The method according to claim 27, wherein each thermally conductive metallic plate has a thickness from 0.020 inches to 0.085 inches.

29. The method according to claim 23, wherein the dielectric spacer is a ceramic material, and the multilayer window is adapted to maintain a vacuum between an interior space and an external environment separated by the multilayer window.

* * * * *